United States Patent [19]

Finn

[11] Patent Number: 4,947,780

[45] Date of Patent: Aug. 14, 1990

[54] MODULAR FLOATING STRUCTURES AND METHODS FOR MAKING

[76] Inventor: Arnold A. Finn, 3605 Conway Gardens Rd., Orlando, Fla. 32812

[21] Appl. No.: 187,267

[22] Filed: Apr. 28, 1988

[51] Int. Cl.[5] ..... B63B 35/38

[52] U.S. Cl. ..... 114/263; 114/266; 114/267

[58] Field of Search ..... 114/263, 266, 267; 405/218, 219

[56] References Cited

U.S. PATENT DOCUMENTS

| | | | |
|---|---|---|---|
| 2,055,703 | 3/1981 | Sluys | 114/267 |
| 4,263,865 | 4/1981 | Shorter | 114/267 |
| 4,318,361 | 3/1982 | Sluys | 114/267 |
| 4,365,914 | 12/1982 | Sluys | 114/267 |
| 4,470,365 | 9/1984 | Sluys | 114/267 |
| 4,559,891 | 12/1985 | Shorter | 114/267 |
| 4,715,307 | 12/1987 | Thompson | 114/267 |

*Primary Examiner*—Sherman D. Basinger
*Assistant Examiner*—Stephen P. Avila
*Attorney, Agent, or Firm*—Duckworth, Allen, Dyer & Doppelt

[57] ABSTRACT

A buoyant module which is useful in the construction of modular docks, marinas and the like is fabricated by providing a buoyant member and applying a protective sheet over a portion of the member, and pumping a fiber-reinforced concrete layer over one face of the buoyant member. Structural rods extending through the layer are interconnected with peripheral whalers, which in turn permit the buoyant member—concrete layer combination to be joined together with similar modules in a unitary, low cost and facile construction.

33 Claims, 6 Drawing Sheets

MODULAR FLOATING STRUCTURES AND METHODS FOR MAKING

BACKGROUND OF THE INVENTION

1. Field of the Invention

The present invention relates to marinas, docks, floats and similar buoyant structures and methods for making those structures.

2. Description of the Prior Art

Marine docks, floats and similar buoyant structures have been fabricated in the past from a variety of conventional materials and utilizing conventional methods.

Under certain conditions, it is desirable to utilize modular structures which are prefabricated in a manufacturing facility in order to assemble the marina, dock or other buoyant structure in a low cost and efficient manner. One such technique is described in U.S. Pat. No. 4,715,307 to Thompson, which discloses a mat having a layer of a glass-reinforced concrete placed over a buoyant element, and with the buoyant element being sprayed with concrete fiberglass reinforcement. Other prior art of interest includes the following U.S. Pat. Nos.: 4,265,193 to Sluys; 4,118,239 to Gagin; 3,936,209 Krage; 3,664,287 to Duff; 3,659,540 to Toby et al; 3,179,076 to Sheffield; and 2,689,381 to Terriere.

SUMMARY OF THE INVENTION

The present invention is directed to a system and method for constructing a dock, float or similar buoyant structure, which comprises the step of fabricating plural buoyant modules according to the preferred embodiment of the method, and attaching those modules together so as to form a marine dock, float or the like.

In accordance with the preferred embodiment of the present invention, each buoyant module is fabricated by providing a buoyant member and forming grooves in at least one exposed surface of the buoyant member, with the grooves extending across the face. The exposed other faces of the buoyant member are coated with a protective sheet. A structural rod is suspended in each groove. A layer of a fiber-reinforced concrete is pumped over the one face of the buoyant member, into the grooves and around each rod in the groove, with the layer being extended to a predetermined thickness above the face and then permitted to set into an interconnecting relation with the rods and the buoyant member face. The first interconnectable whalers are then attached against at least a portion of the periphery of the layer. Suitably, the whalers are attached to the buoyant member-concrete layer combination by utilizing the extremities of the embedded structural rods. The rods may also be utilized during the fabrication step to attach forms along the side of the buoyant member, in order to define the concrete layer.

It is preferred that the protective sheet also comprises a fiber-reinforced concrete, having longer fiberglass strands than the fiber-reinforcement of the concrete layer.

After construction of plural modules in accordance with the steps outline above, the method of the present invention may be further utilized to assemble a dock from the plural modules by interconnecting the modules at the whalers. Two or more interconnected modules then form a unitary structure which is easily assembled at the desired location. Individual modules may utilize a buoyant member of a thickness different than other modules, a different density, or both in order to obtain modules of different freeboard or weight-loading characteristics. Additionally, adjacent modules may be spaced one from the other so as to permit an architectural element to be extended between the modules and suspended above water when the interconnected modules are placed in the desired location. Such architectural elements may serve a primarily aesthetic function, or may serve a useful function as, for example, a knee brace between a lateral run of modules forming a finger dock extending away from a center span.

The modular construction technique of the present invention thus provides a relatively low cost structure with a high degree of flexibility which may be fabricated in a short time, and installed in a facile manner.

DESCRIPTION OF THE PREFERRED EMBODIMENT

A preferred embodiment of the system and method for making an individual module for use with a multiple module construction will now be described with reference to FIGS. 1–10. Of course, it will be appreciated by those skilled in the art that minor variations and modifications may be practiced without departing from the spirit and scope of the system and method of the present invention.

Figure 1:
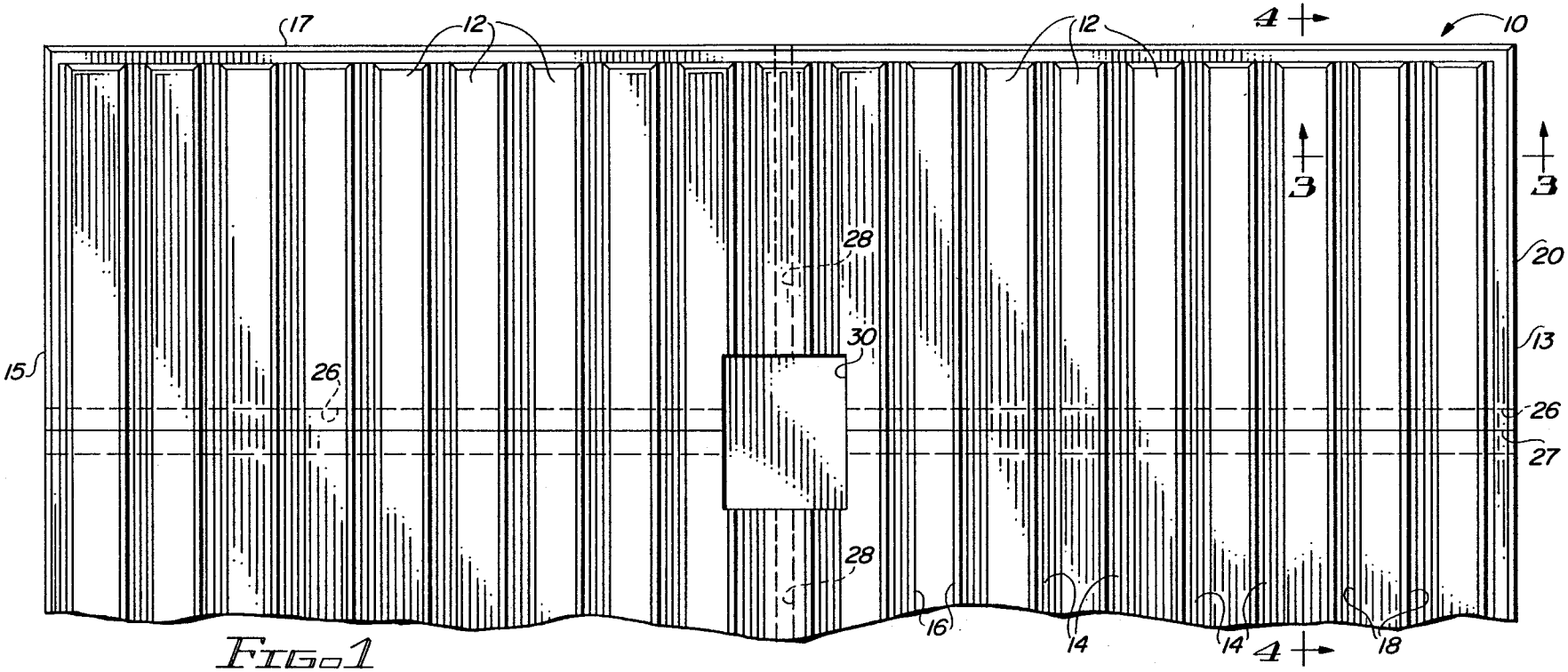
FIG. 1 is a top plan view, partially broken away, of a buoyant member useful in the method and structure of the present invention.
Figure 2:
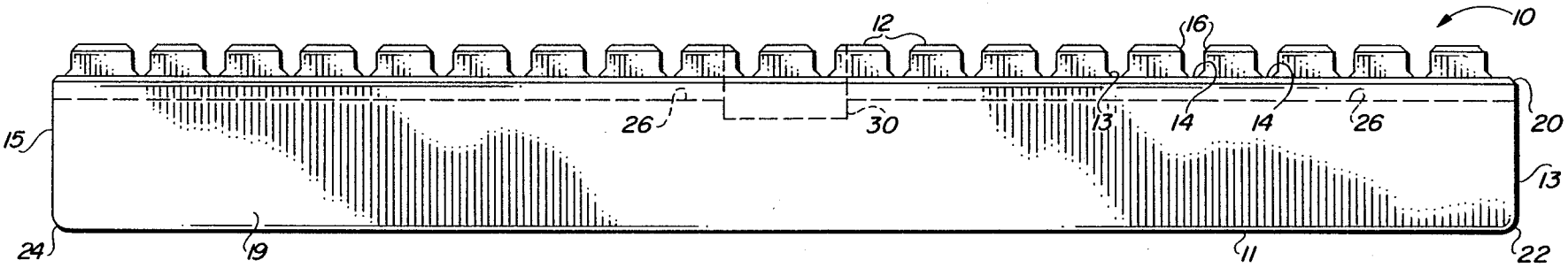
FIG. 2 is a side elevation of the buoyant member shown in FIG. 1.

Noting FIGS. 1 and 2, there is first provided a buoyant member 10 having an exposed upper face 12. By way of example, a styrofoam block having a 1.1 pound density is suitable. However, the specific dimensions and buoyancy of the number 10 are not critical, and may be substantially varied to achieve a wide variety of freeboard and loading characteristics for each module.

Figure 3:
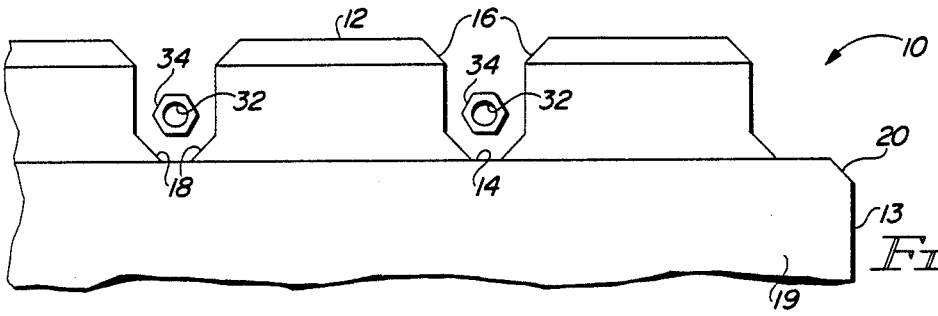
FIG. 3 is a cross-sectional view of a portion of the buoyant member shown in FIG. 1, taken along the lines 3—3.

A plurality of grooves 14 are formed in the buoyant member 10 and extend from the first face 12; it is preferred that the grooves 14 extend generally parallel to each other and laterally across the short dimension (i.e., width) of the buoyant member 10, but in some instances the grooves may extend longitudinally across the long dimension. As is shown in FIGS. 2 and 3, each groove is formed such that the upper portion of the groove has an outward bevel 16, and an inward bevel 18 at the bottom of the groove, so that the upper dimension is wider than the lower dimension. As will be evident from the structure shown in FIG. 8, the bevels 16, 18 prevent the formation of stress lines after each groove is filled with reinforced concrete. An edge bevel 20 is formed about the periphery of the buoyant member 2, and below the level of the one face 12.

After formation of the grooves 14 in the one, upper face 12 of the buoyant member 10, the member has an opposing bottom face 11, opposing end faces 13 and 15, and opposing side faces 17 and 19 which remain exposed until covered by a protective sheet 36, as described further below. The corners of the buoyant member 10 (for example, corners 22 and 24) are bevelled to insure a continuous deposition of the protective sheet 36.

Although not necessary, it is desirable to form a longitudinal utility chase 26 in the buoyant member 10 below the level of the grooves 14. Additionally, a lateral utility chase 28 may likewise be provided. Both utility chases 26, 28 communicate with a central utility opening 30 formed in the upper, one face 12 of the buoyant member 10.

The grooves 14, bevels 16, 18, utility chases 26 and 28 and utility opening 30 may all be formed in the styrofoam buoyant member 10 utilizing conventional "hot wire" forming techniques, in which a thin hot wire is brought in contact with the high density styrofoam body, and used to slice away portions of the member to form the desired configuration. In order to form the utility chases, the hot wire may, for example, be extended downwardly into the buoyant member along a longitudinal line 27, to the desired depth, and then the utility chase 26 formed.

Figure 4:
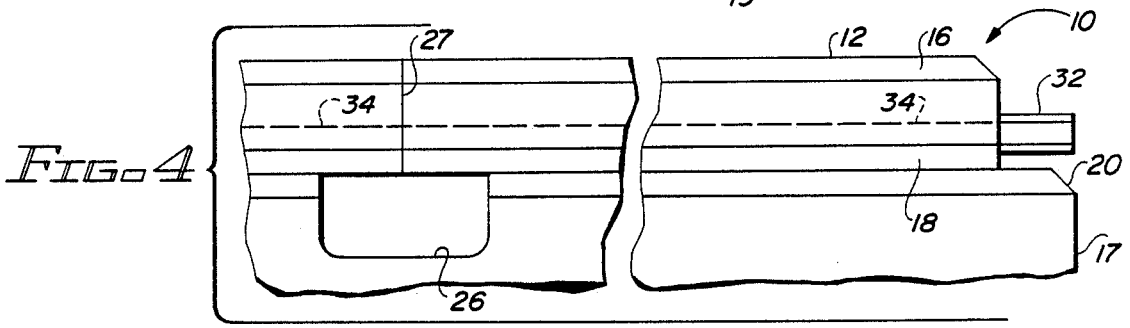
FIG. 4 is a cross-sectional view of a portion of the buoyant member shown in FIG. 1, taken along the lines 4—4.
Figure 5:
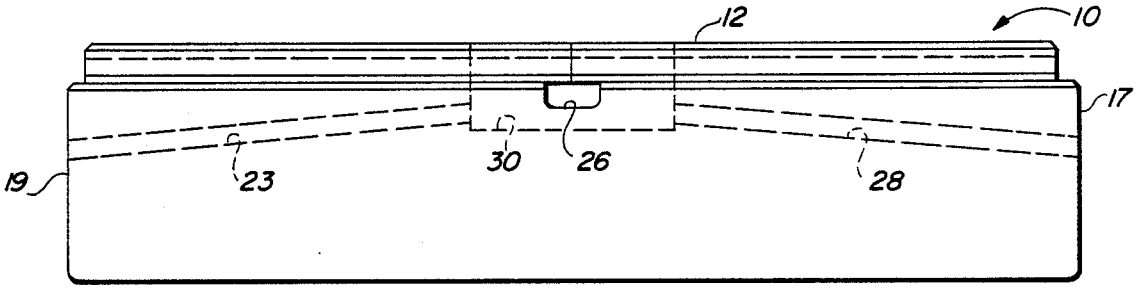
FIG. 5 is an end view of the buoyant member shown in FIGS. 1 and 2.
Figure 14:
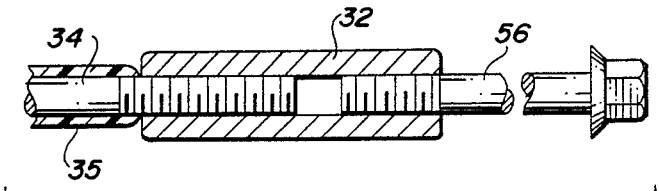
FIG. 14 is a cross sectional side view of the connectors for individual modules.

Referring now to FIGS. 3 and 4, after the buoyant member 10 is configured in the desired manner, then a structural support rod 34 is suspended in each groove 14. Each structural rod 34 has a protective sheath 35 (see FIG. 14); each rod may be slideably engaged in its corresponding sheath, and is dimensioned so that both extremities of each rod extend somewhat beyond the raised area forming the upper, one face 12 of the buoyant member 10. Each extremity of each rod 34 has a threaded connector 32 attached thereto.

Figure 6:
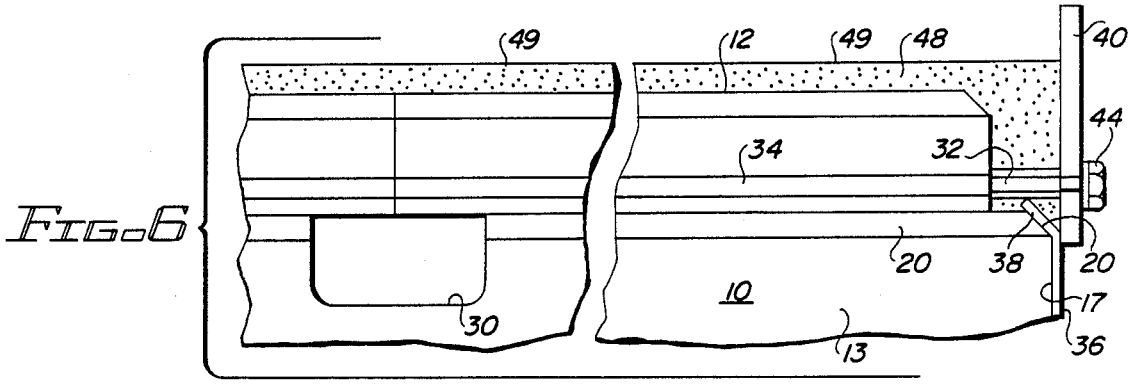
FIG. 6 is a view similar to FIG. 4, illustrating steps in the method for manufacturing a module in accordance with the present invention.
Figure 7:
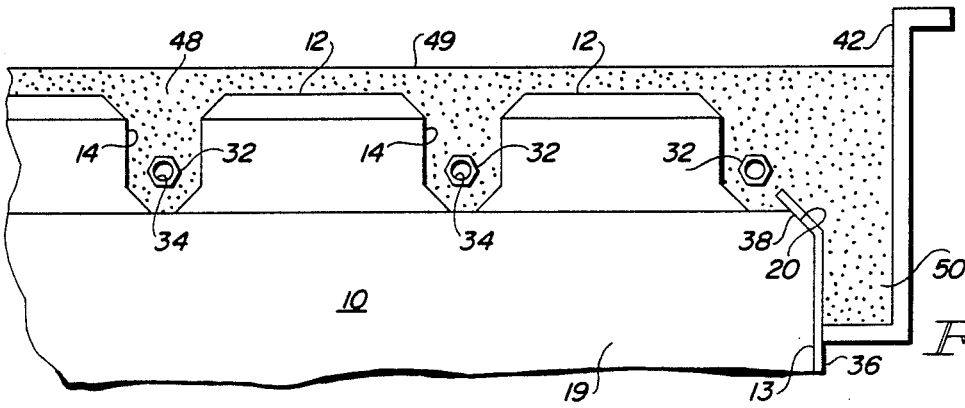
FIG. 7 is another view like FIG. 6, illustrating steps in the method of the present invention.
Figure 8:
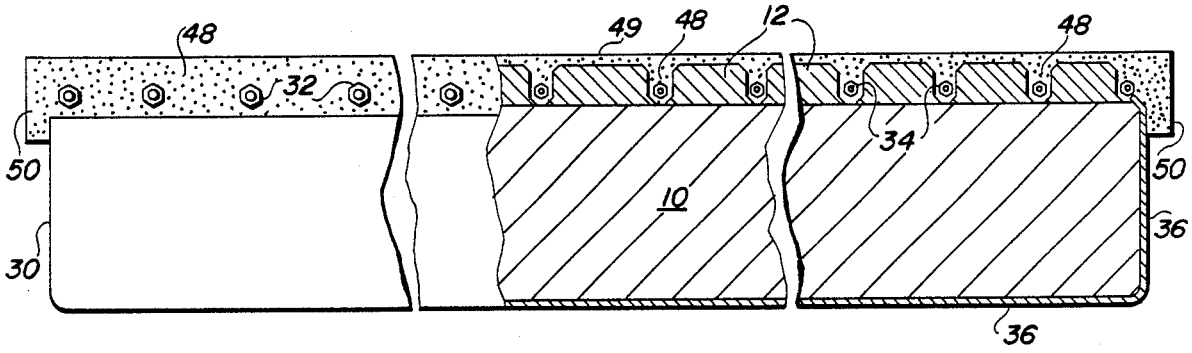
FIG. 8 is a side view, partially broken away, illustrating the buoyant member after completion of some of the steps in the method of the present invention, including those steps illustrated in FIGS. 6 and 7.

Reference is now made to FIGS. 6, 7 and 8. As a next step, a thin, protective sheet 36, (for example a fiberglass-reinforced concrete or polyresin) on the order of ⅜" thick is deposited (as by spraying, for example) over the other exposed faces 11, 13, 15, 17 and 19 of the buoyant member 10, and upwardly along the bevel 20 about the upper periphery of the buoyant member. It will be appreciated that the densified sheet 36 is inert when the buoyant member 10 is floating in water, and thus the sheet 36 serves as a barrier to intrusion of water into the styrofoam member 10.

As shown in FIG. 6 and 7, a longitudinal steel form member 40 is attached alongside the buoyant member 10 and overlaps the protective sheet 36. The steel form 40 may be joined to the buoyant member 10 by the use of threaded bolts 44 extending into the connector 32, to hold the form 40 in the desired position. Likewise, as is shown in FIG. 7, a lateral steel form 42 is provided, and extends outwardly a short distance from the protective sheet 36. Thereafter, using the forms 40, 42 as a barrier, a fiberglass-reinforced concrete layer 48 is pumped into the grooves 14, around the structural rods 34 and the connectors 32, and to a predetermined thickness above the upper, one face 12 of the buoyant member 10. Preferably, the fiberglass-reinforced concrete layer 48 includes a pea-grade aggregate, and fiberglass strands which are shorter than the strands utilized for the protective sheet 36. The concrete layer 48 is permitted to set into interconnecting relationship with the rods 34, connectors 32 and against the buoyant member face 12, thus forming an upper support surface 49 for the entire structure. After the concrete layer 48 has completely hardened, then the threaded bolts 44, and forms 40, 42 are removed, leaving a single floatable unit, as is shown in FIG. 8, which may serve as a module for a marina, dock or other buoyant structure. It will be appreciated that the threaded outer extremity of each connector 32 is exposed at the periphery of the concrete layer 48, and thus can be utilized to interconnect the module with another, adjacent module in the manner which will now be described with reference to FIGS. 9 and 10.

Figures 9, 10, 11, 12, 13:
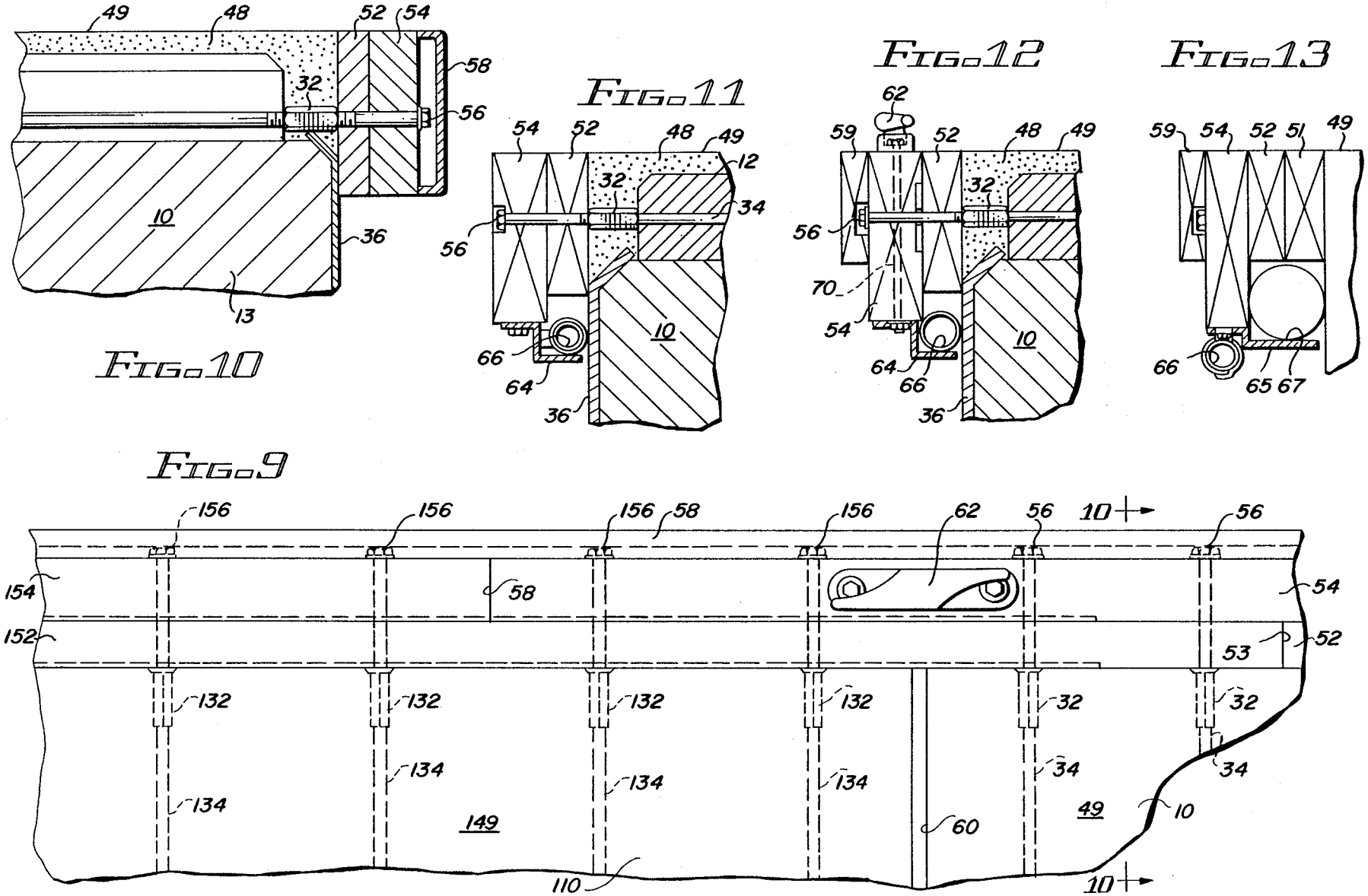
FIG. 9 is a top plan view of portions of two modules constructed in accordance with the method illustrated in FIGS. 1-8, and illustrates the manner in which multiple modules are joined together in accordance with the present invention.
FIG. 10 is a cross-sectional elevation of a portion of FIG. 9, taken along the line 10—10.
FIGS. 11, 12 and 13 are cross sectional elevations of a portion of one module of the present invention, illustrating alternative construction details.

In FIG. 9, there is shown a portion of two interconnectable modules, each formed in accordance with the method described above. A first module is referred to by its inclusive buoyant member 10, and includes the various elements described and shown in FIGS. 1–8. The second module, referred to by reference numeral 110, includes various components and elements essentially the same as the components and elements of the module 10, and which are referred to by like reference numerals preceded by the prefix "1". For example, module 110 includes connectors 132, structural rods 134 and an upper support surface 149. It will be understood that module 110 is essentially identical to the module 10. In order to join the first module 10 and the second module 110 together, there is provided a course of first interconnectable whalers 52, 152 extending along the longitudinal sides of the buoyant member 10, against the periphery of the concrete layer 48 and lapping over the protective sheet 36 (note FIG. 10). Each first, interconnectable whaler 52, 152 preferebly is formed of a wooden board (although other materials are suitable), on the order of 3"×8", and is of sufficient length to overlap the side of the adjacent one of the modules 10, 110, so as to interconnect with at least two of the connectors 32, 132 of the adjacent module. Thus, first whaler 152 of second module 110 overlaps the joint 60 between the two modules, and also overlaps at least two of the connectors 32. Similarly, another course of second, interconnectable whalers 54 and 154, on the order of 4"×12", are extended across and in overlapping relationship to the first course of whalers 52, 152. That is, second whaler 54 overlaps the joint 53 between first whalers 52 and 152; similarly, the joint 58 between second whalers 54 and 154 is spaced from the joint 53. The first whalers 52, 152 and second whalers 54, 154 are joined to the respective first and second modules 10 and 110 by machine bolts 56 and 156, each of which extends through the adjacent courses of first and second whalers 52, 152 and 54, 154, and into a corresponding one of the threaded connectors 32, 132. As thus assembled, the first and second modules 10, 110 are joined together in a rigid, unified construction.

A resilient rub rail 58 may be attached to the second whaler course 54, 154 to protect marine vessels from the whalers 54, 154, and bolts 56, 156. A conventional cleat 62 is shown attached to the second course of whalers 54.

Details and alternative forms of the construction are shown in FIGS. 11–14. In FIG. 11, a conventional water line 66 may be extended along one longitudinal side of numerous interconnected modules (for example, modules 10 and 110 in FIG. 9) by the use of an appropriate bracket 64. As shown in FIG. 12, the bracket 64 is shown attached to a through bolt 70, which in turn fastens the cleat 62 to the unified construction. Likewise, in FIG. 12 there is shown a rub rail 59 as an alternative form which comprises a wood member 59 having a groove to receive the head of the machine bolt 56; it will likewise be understood that the second whaler 54 may be recessed to receive the head of the machine bolt 56. In FIG. 13, details are shown for a triple whaler construction, in which two inner whaler courses 51, 52 are attached, so as to create sufficient thickness to permit an oversized fuel line 67 to be carried by a bracket 65 and protected by the whaler system.

Figure 15:
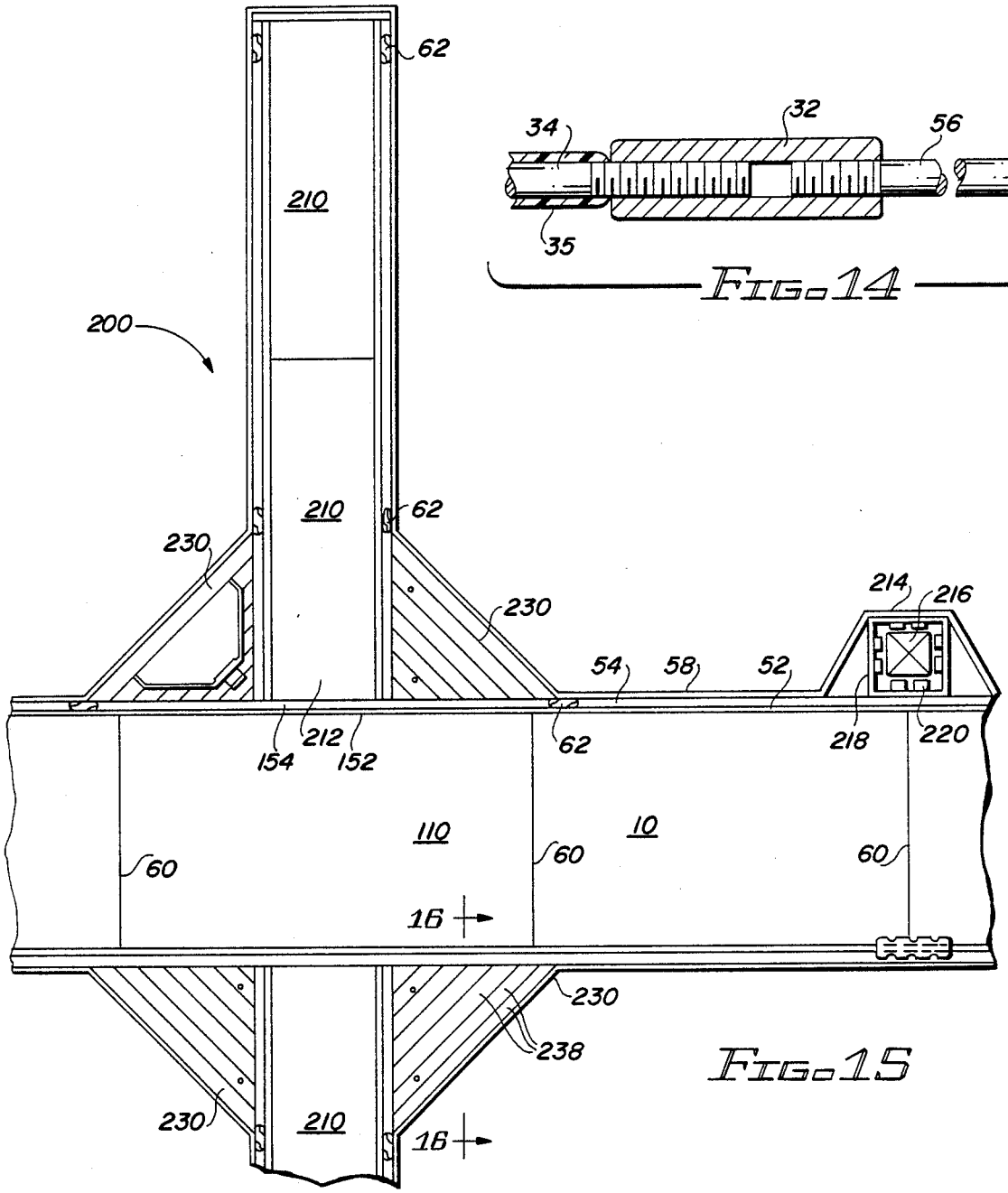
FIG. 15 is a top plan view of a portion of a multiple module layout for a dock in accordance with the present invention, in which certain modules form a center span and other modules form lateral finger piers for the dock.

A first marina construction utilizing a plurality of buoyant modules fabricated in accordance with the present invention will now be described with reference to FIG. 15. The marina construction, referred to generally by the reference numeral 200, includes a central span formed by identical modules like that shown and described with reference to FIG. 9, and which are arbitrarily identified as modules 10 and 110 in FIG. 15. Thus, the two modules 10 and 110 are interconnected by the system of whalers 52, 152 and 54, 154. Additionally, the marina construction 200 includes finger piers formed of identical buoyant modules 210 which are fabricated in the manner described above, and which are likewise interconnected via corresponding whaler systems in the same manner. It will be appreciated that the buoyant modules 210 may be specifically designed so that their corresponding upper surfaces are in the same plane with the upper surfaces of the modules 10, 110 or, in the alternative, may be specifically designed to be either less buoyant or of a lesser thickness (or both) so as to achieve a lower freeboard. Under these circumstances, an area 212 of the buoyant module 210 next adjacent the center span module 110 may be provided with a ramp or similar means to permit persons to walk down onto the finger pier formed by the buoyant modules 210.

It will of course be understood that the buoyant modules 10, 110 and 210 are designed to float on the surface of the body of water into which the construction 200 is placed. Under certain circumstances, however, it may be desirable to attach the construction 200 to pilings, such as pilings 216, so as to prevent lateral movement of the construction 200 across the top of the surface of the body of water. To this end, a frame 214 is provided, including frame sides 218 and rollers 220, which engage the piling 216 in such a manner as to permit the construction 200 to rise and fall with the level of the body of water into which the marina construction 200 is placed.

Figure 16:
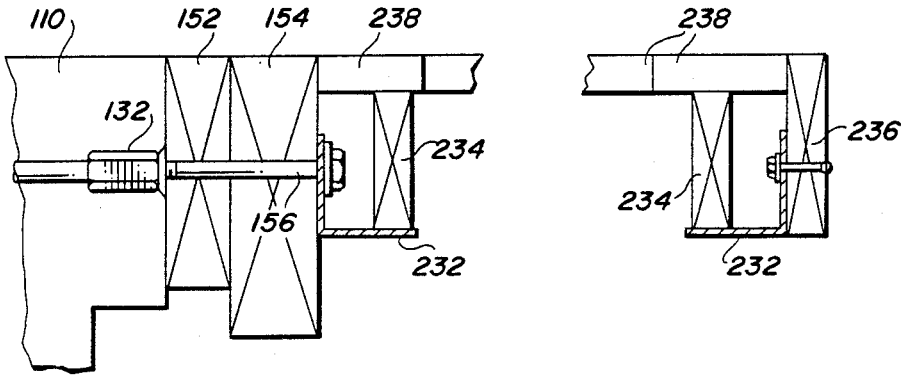
FIG. 16 is a cross sectional elevation, partially broken away, of a portion of the dock shown in FIG. 15, taken along the lines 16—16.

For both utilitarian and aesthetic reasons, it may be desirable to place certain architectural elements between adjacent buoyant modules. An example of such an architectural element is shown as knee brace decks 230, which serve the function of bracing the finger piers formed by buoyant members 210 with the central span, and also provide a pleasing, aesthetic appearance. Each knee brace deck 230 is formed of slats 238, and is interconnected between adjacent buoyant modules and is shown in detail in the cross sectional, broken away side elevation of FIG. 16. As is there shown, two steel L brackets are provided, and are respectively attached to the second whaler 154 and to a support stud 236. Additional support studs 234 are provided, with the slats 238 extending across the support studs to form the knee brace deck 230.

Figure 17:
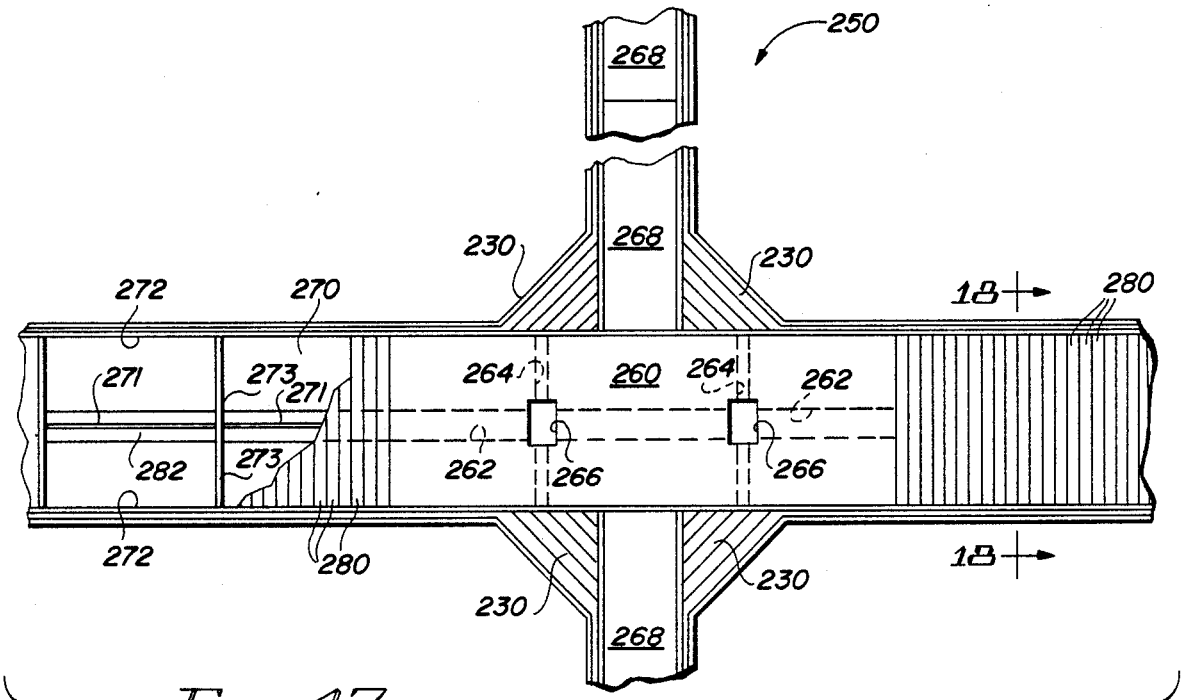
FIG. 17 is a top plan view of a multiple module floating dock similar to FIG. 15, illustrating a floating module with aesthetic architectural features.
Figure 18:
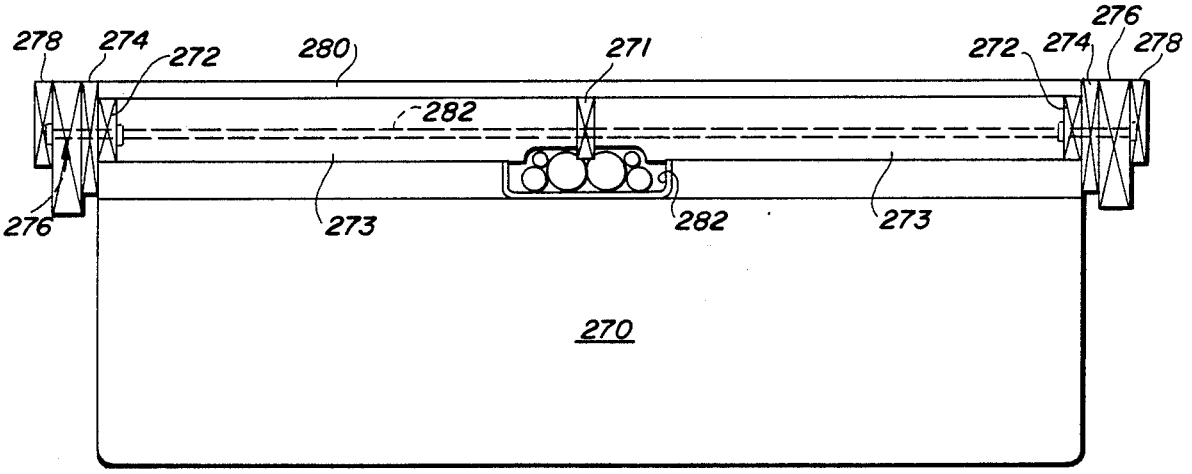
FIG. 18 is a cross-sectional elevation of FIG. 17, taken along the line 18—18.

Another alternative form of an architectural element useful with the present invention is shown in FIGS. 17 and 18 where the composite marina construction is referred to generally by the reference numeral 250 and includes a central module 260 fabricated in accordance with the method described above with reference to FIGS. 1–8. The module 260 includes a central, longitudinal utility chase 262, and lateral utility chases 264, all of which communicate with two spaced utility openings 266. Second individual modules 268 form finger piers, much in the manner described above with reference to FIG. 15. The modules 268 are braced by knee brace decks 230. As is shown on the right and lift hand sides of FIG. 17 and in cross section in FIG. 18, there is provided a bridging module provided with wood planks 280 as an upper surface. Noting FIG. 18, each of these modules includes a buoyant member 270, longitudinally extending center joist 271 and longitudinal side joist 272. A lateral brace 273 extends between each side joist 272 and the center joist 271. First and second whalers 274 and 276 are provided, with a rub rail 278 forming an outer surface. Structural rods 282 extend laterally across each of the modules, and interconnect the side joist and whalers 274, 276. The wooden planks 280 overly and are connected to the central and side joist 271, 272. A fiberglass utility chase 282 is suspended from the bottom of the braces 273 to carry various water lines, fuel lines and the like (not numbered but shown in the cross section of FIG. 18).

Figure 19:
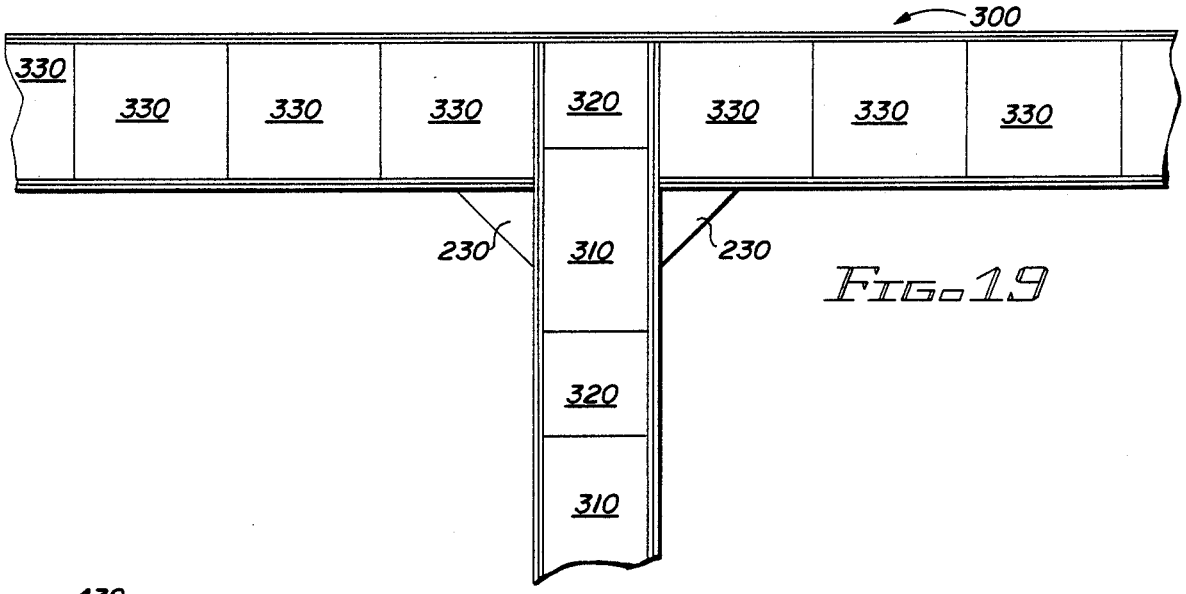
FIG. 19 is a top plan view of a multiple module docking structure fabricated in accordance with the present invention.

A second marina construction 300 is shown in FIG. 19, and comprises a T-shaped construction formed of multiple modules, consisting of three different modules 310, 320 and 330. The floating modules are interconnected via the whaler system described above, and are provided with knee braces 230.

Figure 20:
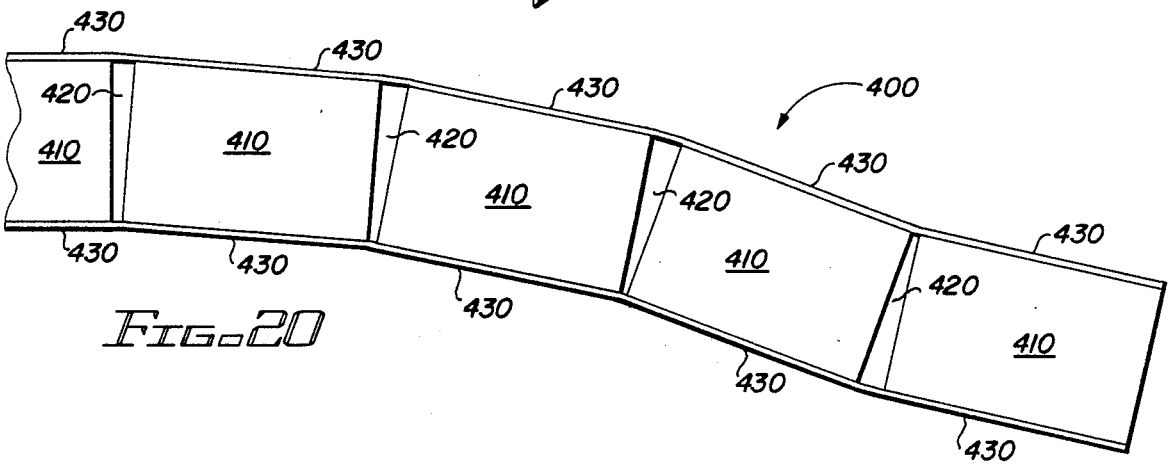
FIG. 20 is a top plan view of a circuitous multiple module floating structure fabricated in accordance with an alternative form of the present invention.

Another alternative form of a floating construction 400 is shown in FIG. 20. The construction 400 is suitable in situations where it is desirable that the floating member take a circuitous path. To achieve this, there are provided plural identical floating modules 410 which are constructed in the manner described above, except that form inserts have been utilized to add curvature to the construction. Between adjacent curved modules 410 there is placed a wedge-shaped whaler 420, so as to facilitate a direction-changing effect to the overall construction. All of the modules 410 are interconnected by whalers 430 in the manner described above.

Figure 21:
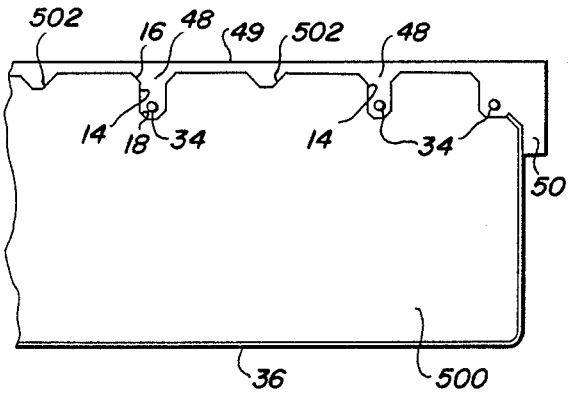
FIG. 21 is a cross-sectional elevation, partially cut away, showing an alternative construction of the present invention.

FIG. 21 discloses optional construction of individual modules in accordance with the present invention, including a buoyant member 500 having grooves 14 and structural rods 34 much like the construction shown in FIG. 8. However, in the construction of FIG. 21, only shallow grooves 502 are placed between adjacent deeper grooves 14 with the overlying layer 48 extending into both the grooves 14 and 502.

Figure 22:
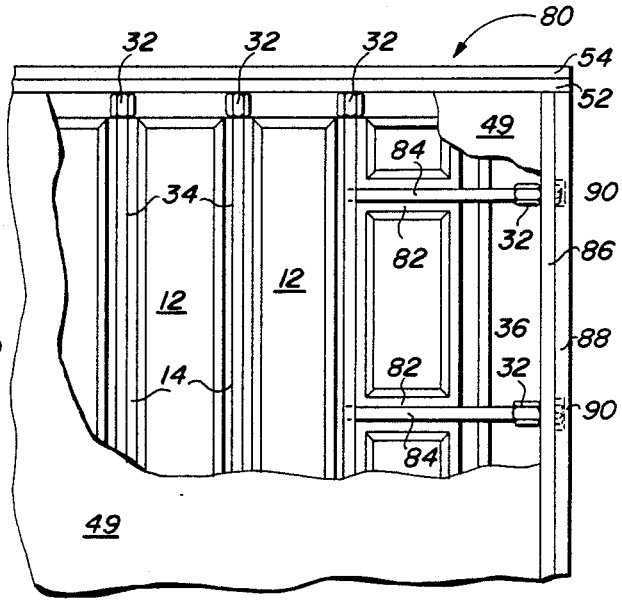
FIG. 22 is a top plan view, partially cut away, of another alternative form of construction.

FIG. 22 illustrates an alternative arrangement 80, in which the buoyant member is provided with lateral grooves 82, and lateral structural rods 84, which extend outwardly through the concrete layer 48 and have connectors 32 at their extremities, in order to permit lateral whalers 86 and 88 to be fastened via bolts 90. Such a construction is useful, for example, at the end of a dock or marina.

It will thus be understood that there is described a low cost, and efficient technique for manufacturing multiple modules, which may be interconnected together to form a complex construction of floating docks and other buoyant structures in a facile manner.

What is claimed is:

1. A method for fabricating a buoyant module for a dock, float or similar buoyant structure, and which module is interconnectable with adjacent modules into a larger construction, said method comprising the steps of:

providing a buoyant member having several faces;

forming grooves in at least one face of said buoyant member, said grooves extending across said one face;

suspending structural rods in some of said grooves;

coating the other faces of said buoyant member with a protective sheet;

thereafter pumping a layer of fiber-reinforced concrete over said one face, into said grooves and around each rod, extending said layer to a predetermined thickness above said one face, and then letting said layer set into interconnecting relation with said rods and said one face; and attaching first interconnectable whalers against at least a portion of the periphery of said layer.

2. The method recited in claim 1 further comprising the step of dimensioning each structural rod such that each rod extremity extends beyond the adjacent side of said one face.

3. The method recited in claim 2 further comprising the step of attaching said whalers to the module with said rod extremities.

4. The method recited in claim 3 wherein said layer pumping and extending steps comprises the steps of:

providing a peripheral form; and attaching said form to said buoyant member with said rod extremities.

5. The method recited in claim 4 further comprising the step of extending structural rods laterally from each opposite end of said one face.

6. The method recited in claim 4 wherein said fiber-reinforced concrete comprises a pumpable concrete having a pea-grade aggregate content.

7. The method recited in claim 4 wherein said protective sheet is inert in water.

8. The method recited in claim 7 wherein said inert protective sheet comprises a fiber-reinforced concrete.

9. The method recited in claim 8 wherein said inert protective sheet comprises a glass fiber-reinforced concrete.

10. The method recited in claim 9 wherein said glass fiber-reinforced concrete sheet has longer fiber strands than said concrete layer over said one face of said buoyant member.

11. The method recited in claim 1 or 8 further comprising the step of applying said protective sheet first and then overlapping said sheet with said concrete layer.

12. The method recited in claim 3 further comprising the step of affixing second whalers against and overlapping said first whalers.

13. The method recited in claim 3 further comprising the steps of:

fixing a threaded connector to each rod and embedding each connector within said layer; and extending a threaded bolt through said whalers and into each threaded connector.

14. The method recited in claim 1 further comprising the steps of:

forming said layer by placing a form about the periphery of said one buoyant member face; and attaching said form to said rods.

15. The method recited in claim 14 further comprising the steps of:

fixing a threaded connector to each rod and embedding each connector within said layer; and extending a threaded bolt through said form and into each connector.

16. The method recited in claim 1 further comprising the step of forming a utility chase in said one face of said buoyant member and below said grooves.

17. The method recited in claim 1 wherein said groove forming step comprises the step of forming each groove substantially wider adjacent the surface of said one buoyant member face than at the groove extremity.

18. The method recited in claim 1 wherein said buoyant member comprises a high density styrofoam.

19. A method for constructing a dock, float or similar buoyant structure, said method comprising the steps of:

fabricating plural buoyant modules according to the method recited in claim 1; and attaching said modules together at the whalers of each module.

20. The method recited in claim 19 further comprising the steps of:

providing a space between adjacent modules; and placing an structural element in said space between said adjacent modules.

21. The method recited in claim 20 further comprising the step of suspending said structural element above water when said buoyant structure is floating.

22. The method recited in claim 19 further comprising the step of fabricating one of said modules with greater buoyancy than another of said modules.

23. The method recited in claim 19 further comprising the step of fabricating one of said modules with greater freeboard than another of said modules.

24. The method recited in claim 19 further comprising the step of fabricating one of said modules with greater buoyancy and freeboard than another of said modules.

25. The method recited in claim 19 wherein said attaching step comprises the steps of:

positioning said rods in a first one of said modules generally parallel across said one buoyant member face of said first module;

attaching said first module whalers to said first module rods and generally normal thereto;

positioning said rods in a second one of said modules generally parallel across said one buoyant member face of said second module;

attaching said second module whalers to said second module rods and generally normal thereto; and overlapping said first module whalers alongside said second module.

26. A method for constructing a dock, float or similar buoyant structure, said method comprising the steps of:

providing two buoyant members;

separately coating each buoyant member with an inert, protective sheet;

thereafter depositing a settable layer on a first, upper face of each buoyant member and overlapping the edge of said sheet, and then permitting said layer to set;

providing interconnecting joinder means about at least a portion of the periphery of each buoyant member; and interconnecting said buoyant members with said joinder means.

27. The method recited in claim 26, further comprising the steps of:

extending structural rods through said settable layer of each module; and interconnecting said structural rods with said joinder means.

28. A buoyant module for a dock, float or similar buoyant structure, comprising:

a buoyant member having several faces with grooves in one of the faces thereof, the grooves extending across the one face;

a protective sheet overlying the other faces of said buoyant member;

a layer of a fiber-reinforced concrete overlying said grooves;

a structural rod extending through said concrete layer in some of said grooves; and interconnection means about at least a portion of the periphery of said layer and interconnected with said structural rods.

29. The module recited in claim 28, wherein said concrete layer overlaps said protective sheet.

30. A dock or similar floating structure, comprising:

a first module as recited in claim 28;

a second module as recited in claim 28; and means joining said interconnection means of said first module with said second module, and joining said interconnection means of said second module with said first module.

31. A method for fabricating a buoyant module, comprising the steps of:

providing a buoyant member of an inert, non-metallic material;

forming recesses in one exposed surface of the buoyant member;

positioning the buoyant member with the one surface extending upwardly; and continuously pumping a fiber-reinforced concrete over the exposed surface, into the recesses to a predetermined thickness above the surface, and then letting the pumped reinforced-concrete set into a monolithic layer inter-connected with the buoyant member in the recesses.

32. The method recited in claim 31 wherein the buoyant member has other surfaces, further comprising the step of coating the other surfaces of the buoyant member with a protective sheet.

33. The method recited in claim 32 further comprising the step of overlapping the edges of the sheet with the reinforced-concrete layer.

* * * * *